US005131574A

United States Patent [19]

Usco et al.

[11] Patent Number: 5,131,574

[45] Date of Patent: Jul. 21, 1992

[54] DEVICE MADE OF A PLATE AND A FRAME PROVIDED WITH LOCKING PIECES SUITABLE TO SIMPLIFY HAND-FOLDING OF SHIRTS AND GARMENTS IN GENERAL

[76] Inventors: Maria Usco; Giorgio Jazbar, both of Via dei Berlam 24, I-34100 Trieste TS, Italy

[21] Appl. No.: 689,430

[22] Filed: Apr. 23, 1991

[30] Foreign Application Priority Data

Jun. 15, 1990 [IT] Italy ..... 59807/90[U]

[51] Int. Cl.[5] ..... A41M 33/00

[52] U.S. Cl. ..... 223/37; 223/38

[58] Field of Search ..... 223/37, 38; 493/405, 493/418, 451

[56] References Cited

U.S. PATENT DOCUMENTS

| | | | |
|---|---|---|---|
| 1,657,551 | 1/1928 | Schremp | 223/37 |
| 1,938,921 | 12/1933 | Meyer | 223/37 |
| 2,370,125 | 2/1945 | Cronin | 223/37 X |
| 2,717,779 | 9/1955 | Currie | 223/37 X |
| 2,988,251 | 6/1961 | Ziegler | 223/37 |
| 3,989,172 | 11/1976 | Wiedmann et al. | 223/37 X |
| 5,011,052 | 4/1991 | Craig | 223/38 X |

*Primary Examiner*—Werner H. Schroeder
*Assistant Examiner*—Bibhu Mohanty
*Attorney, Agent, or Firm*—Browdy and Neimark

[57] ABSTRACT

Device made of a plate and a frame provided with locking pieces, suitable to simplify hand-folding of shirts and garments in general.

The device solves the problem of folding shirts and garments in general.

The manual device is composed of a plate (1) and a frame (2) provided with locking pieces (such as bars (3). They are hinged together along one of the shortest sides of the device. The locking pieces are secured to two or more sides of the frame (2). Plate (1) and frame (2) have a similar shape. The latter surrounds plate (1) externally when the device is being used.

The shirt (4) (or another garment) is kept stationary on plate (1) by the frame (2) and the locking pieces.

The shirt (4) is then turned upside-down, folded from the back and turned upside-down again.

In the end, the device is opened and the shirt (4) is slipped off, which is perfectly folded.

5 Claims, 2 Drawing Sheets

DEVICE MADE OF A PLATE AND A FRAME PROVIDED WITH LOCKING PIECES SUITABLE TO SIMPLIFY HAND-FOLDING OF SHIRTS AND GARMENTS IN GENERAL

BACKGROUND OF THE INVENTION

1. Field of the Invention

Those whose deal with cleaning and ironing of shirts, T-shirts, etc. are generally concerned with the need to fold them.

Even though the operation is apparently easy for some, those who rarely perform folding sometimes find it a complex and prohibitive operation.

However, even those who perfectly master the folding technique may perform it uncorrectly and time is therefore needed to iron and fold the garment again, etc.

Correct folding is essential when a shirt (or other garments) are to be put in a suitcase before a journey is started. If folding has not been correctly performed, when the suitcase is opened at destination, the garment is in awful conditions and it is not advisable to put it on.

2. The Prior Art

As far as is known, there are no devices available to simplify folding procedures. Folding is generally performed using no devices: the garment is spread on a flat surface, sleeves are folded and laid over the back of the garment, and the whole garment is then folded twice or three times. The parts of the garment are nevertheless not perfectly symmetrical to each others and small and unsightly creases are formed as a consequence.

The first aim of the invention is that of providing users with a device to be manually used which makes up for the abovementioned inconveniences and allows perfect folding of shirts and other garments.

It will then be possible to put those garments on shelves, in suitcases, etc, without risking their being creased and not wearable.

Secondly, the invention is aimed at having all garments folded in the same size.

SUMMARY OF THE INVENTION

The above-mentioned objectives can be achieved by using the device, which is composed of a plate and a frame of similar shape which is provided with locking pieces.

The frame and the plate are connected together by simple hinging elements which are located on one end only. The frame size is slightly bigger than plate size so that during operation the plate is surrounded by the frame. The Plate and frame have approximately the same thickness, The frame is provided with locking pieces (such as small bars, small flat bars or others) secured to two or more sides of the frame, inward it, and arranged on one of the two ideal bases of the frame. The plate (and frame, too) may be of rectangular shape or may have a shape similar to the one of the garment model which is to be folded most frequently.

The section of at least three sides of the frame is preferrably rectangular and the longest side of the section is parallel to the longest side of plate section.

Both plate and frame are made of heat-resistant materials. The size of the device is proportional to the size of the garment to be folded.

DESCRIPTION OF THE DRAWING AND OF PREFERRED EMBODIMENT

Additional advantages and features of the invention will be apparent from the description of the preferred but not sole embodiment of the manual device herein, which is described in the attached drawings (as an indication) for the purpose of illustration and not to restrict its features;

Figure 1:
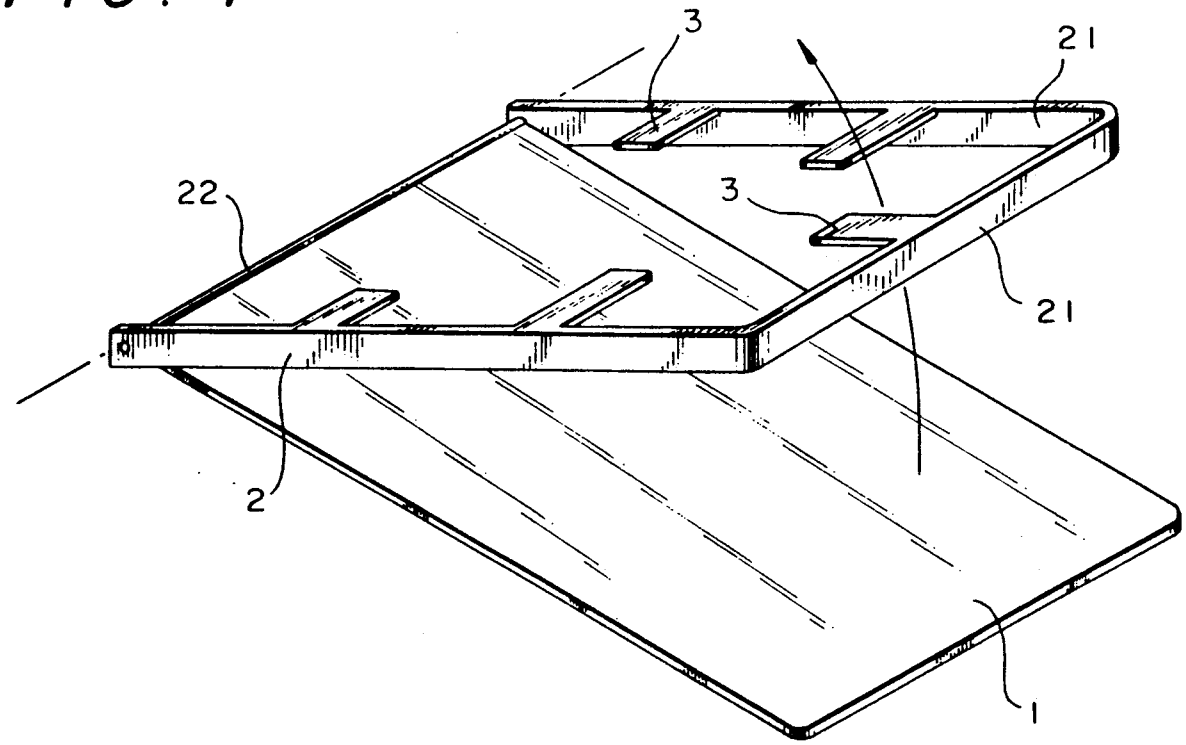
FIG. 1 shows the device herein in perspective.

In details, the manual device herein is designed to simplify folding procedures and is composed of a rectangular plate 1, a frame 2 and small bars 3.

The frame 2 is of rectangular shape, too, and is composed of three connected bars 21 which are in turn connected to a round section bar 22 (which is one of the two shortest sides of frame 2 itself).

Bars 21, which are the two longest sides and one of the shortest sides of frame 2 have rectangular section, the two longest sides being parallel to the long side of plate 1 section.

Frame 2 is hinged to one of the shortest sides of plate 1 by the round section bar 22, which is kept in place by small flat bars (not shown in the drawings), which are wound transversally around bar 22 and are locked to plate 1 itself. Due to the hinge, frame 2 can be rotated of approximately 360° to plate 1.

The rectangular frame 2 is slightly bigger in size as compared to plate 1, thus a narrow slot is there in-between the two pieces when the device is being used.

Figure 2:
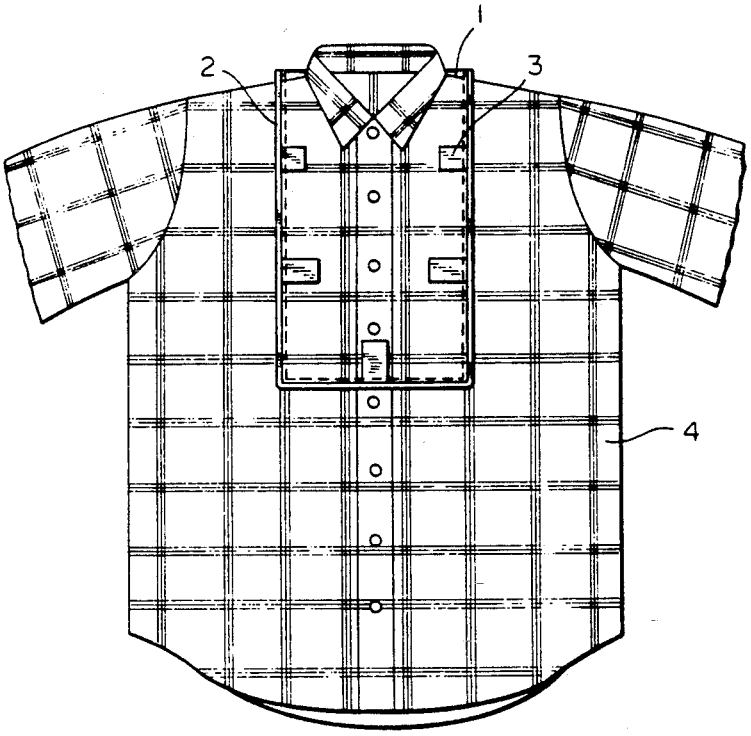
FIG. 2 shows a top view of the device during operation; a shirt, seen from above, is laid between the plate and the frame.
Figure 3:
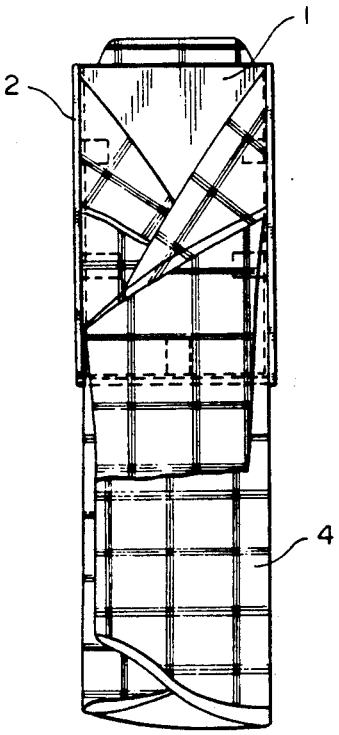
FIG. 3 shows a view of the invention seen from the bototm; a shirt (seen from the bottom), which has already been folded laterally is laid between the plate and the frame.
Figure 4:
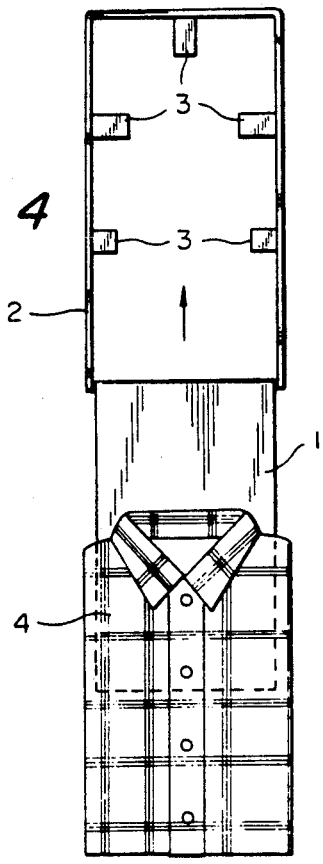
FIG. 4 shows a top view of the device; it is completely open and it is nearly to be slipped off the shirt which is now completely folded (top view).

Bars 21 of frame 2 are provided with locking pieces such as small bars 3, which are secured at right angles to each bar 21, inwards from frame 2 and arranged on one of the two ideal bases of the latter. FIG. 2, 3 and 4 show how the device herein is to be used. More in details, when shirt 4 (which has already been buttoned and ironed) is to be folded, the device has to be completly opened, then the garment is laid on the rectangular plate 1, so that the central-upper part (bib) covers plate 1 completly.

After shirt 4 is laid as described, frame 2 is lowered till it completly surrounds plate 1. The garment is now completely stationary on the device: small bars 3 depress shirt 4 on plate 1 from above; frame 2 holds shirt 4 in place laterally, thus preventing it from moving.

Small bars 3 are also designed to prevent frame 2 from passing over plate 1.

Plate 1, and consequently shirt 4 are then turned upside-down, Shirt 4 is then manually folded following the traditional procedure, and case is taken to have its sides coincide with the longest sides of plate 1. The garment is then half-folded and turned upside-down on plate 1, so that its lower side is over the shortest side of plate 1 (which is taken by the round section bar 22).

Finally, the device is turned upside-down again (and consequently shirt 4 which is already folded), frame 2 is raised (thus releasing the garment) and the device is removed from shirt 4, logitudinally.

The garment is now perfectly folded, The pressure exerted by small bars 3 and frame 2 on shirt 4 (laid on plate 1) prevents the shirt 4 from moving during the folding procedure. A final touch can be given by ironing shirt 4 out to definitely set its shape or to make up for slight imperfections, if any, which are anyway of minor extent.

In order to avoid damaging the device, all its components are made of heat-resistant materials.

It is taken for granted that the garment to be folded and the device have proportional sizes. In other words, the device is to have a small size when used on childrens' garments; it is to have larger sizes for teen-agers' garments and even larger sizes for adults' garments.

Within said age groups, devices of different sizes may be used for one (or more) garment sizes.

Materials and sizes of the invention as described herein and illustrated in the attached drawings, and which is claimed further on may in all cases vary according to different requirements. Furthermore, all components may be replaced with others having equivalent features and this does not imply being beyond the domain to be safeguarded by the patent herein.

We claim:

1. A device for assisting and simplifying the hand-folding of a shirt or blouse, said device comprising;

a flat rectangular plate (1) having three sides around which the shirt or blouse will be folded;

an integral u-shaped frame (2) for maintaining the shirt or blouse against said plate (1) when the shirt or blouse is being folded over said three sides;

said integral u-shaped frame (2) rotatably mounted to one edge (22) of said flat rectangular plate (1);

a plurality of projections (3) on said integral u-shaped frame (2) limiting rotation of said frame around said flat rectangular plate (1) while maintaining the shirt or blouse to be folded between said integral u-shaped frame (2) and said flat rectangular plate (1).

2. The device of claim 1, wherein a u-shaped slot sufficient to accommodate the thickness of the shirt or blouse to be folded is formed between said integral u-shaped frame (2) and said rectangular plate (1) while maintaining the shirt or blouse to be folded between said integral u-shaped frame (2) and said rectangular plate (1).

3. The device of claim 2, wherein, the thickness of said integral u-shaped frame (2) and said rectangular plate (1) are substantially equal.

4. The device of claim 3, wherein, said plurality of projections (3) is directed inward on said integral u-shaped frame (2) to engage the shirt or blouse on said rectangular plate (1).

5. The device at claim 4, wherein, said device is made from heat-resistant material.

* * * * *